United States Patent [19]

Thompson

[11] Patent Number: 4,574,571

[45] Date of Patent: Mar. 11, 1986

[54] APPARATUS FOR AND METHOD OF MANUFACTURING TAPED PRODUCTS WITH DOUBLE TWIST EQUIPMENT

[75] Inventor: Walter F. Thompson, Willowdale, Canada

[73] Assignee: Ceeco Machinery Manufacturing, Ltd., Concord, Canada

[21] Appl. No.: 638,880

[22] Filed: Aug. 8, 1984

[51] Int. Cl.[4] ..... D07B 3/10; D07B 7/14

[52] U.S. Cl. ..... 57/3; 57/6; 57/9; 57/58.49; 57/58.57; 57/58.65

[58] Field of Search ..... 57/3, 6, 9, 13, 31, 57/58.49, 58.52, 58.57, 58.65, 58.67, 58.68, 58.7, 58.83, 311, 264, 58.59

[56] References Cited

U.S. PATENT DOCUMENTS 1,956,730 5/1934 Reichelt ..... 57/3
4,332,131 6/1982 Palsky ..... 57/13 X
4,359,860 11/1982 Schleese et al. ..... 57/13 X
4,530,205 7/1985 Seiler et al. ..... 57/9

FOREIGN PATENT DOCUMENTS 35037 4/1978 Japan ..... 57/58.65

*Primary Examiner*—Donald Watkins
*Attorney, Agent, or Firm*—Lilling & Greenspan

[57] ABSTRACT

Apparatus and method of manufacturing taped products with double twist machines are disclosed which include paying off one or more continuous filaments, and paying off one or more tapes, the tapes are filaments are pulled through a pre-twisting apparatus which imparts a number of twists twist to the assembled filaments and tapes to a number required to determine the desired tape tension in the final product, the pretwister speed is about twice the speed of the bow of the double-twist machine.

28 Claims, 4 Drawing Figures

APPARATUS FOR AND METHOD OF MANUFACTURING TAPED PRODUCTS WITH DOUBLE TWIST EQUIPMENT

BACKGROUND OF THE INVENTION

1. Field of the Invention

The invention relates to wire machinery and more specifically, to an apparatus for and method of manufacturing taped conductors and assemblies on double twist twinners, quadders, bunchers, twisters or stranders.

2. Description of the Prior Art

Machines sometimes denominated as stranders, twisters, single and double twist twinners, quadders, single and double twist stranders, cablers and bunchers have been in existence for many years. These machines are used to combine a plurality of individual wires and bunch or strand them together by imparting a single or a double twist to them.

Typically, the individual strands or wires are payed off from a plurality of bobbins and directed at one input end of the machine or at both ends of the machine in the case of bunchers as described in U.S. patent application Ser. No. 602,667, assigned to the assignee of the subject application.

The wires are grouped or bunched together at the closing point prior to the entry into the machine. The closing point remains fixed relative to the main part of the machine.

The bunched wires or strands are then introduced into one end of a bow which rotates about the longitudinal axis of the machine. In the case of double twist bunchers, it is the rotation of the bow that imparts a first twist to the wires at the input end of the bow while passing a first input pulley or sheave. Leaving the bow at the other end, the bunched and now single twisted wires pass over a second exit pulley or sheave which rotates with the bow. From this rotating sheave the bunched or stranded cable is directed over a sheave that is mounted on a cradle that is stationary in relation to the frame of the machine.

A second twist is imparted to the wire between the last sheave mounted on the bow and the sheave attached to the cradle. Additional pulleys disposed within the space defined by the rotating bow guide the now double twisted cable or wires to the bobbin supported within the stationary cradle and are wound on the bobbin itself while being evenly distributed thereon. Depending on the machine, slightly different wire guide systems have been used.

Double twist twinners, bunchers and closers have been extensively used in the electrical wire and cable, steel tire cord and steel rope industries for many years.

Typical machines are illustrated in the "Electrical Wire & Cable Machinery" catalog published by Ceeco Machinery Manufacturing Limited, the assignee of the subject application. Other exemplary structures of existing machines are disclosed in U.S. Pat. Nos. 3,570,234 and 3,732,682.

Machines for twisting a plurality of wires with the single twist system comprise a rotatable flyer and a reciprocally traversing reel rotatably supported within the flyer. A speed differential exists between the rotation of the flyer and the reel. A plurality of wires are fed from sources external to the machine, to the flyer for twisting the strands together. Due to the differential in rotation rates, the twisted strands are then wound from the flyer onto the reel.

In order to keep a constant lay, the rotation of the flyer and of the bobbin are controlled in such a way that a constant lay is maintained and a single twist is imparted to the individual wires fed through the flyer and onto the reel. Machines of this kind are described, for example, in U.S. Pat. Nos. 2,817,948 and 4,235,070.

The above machines are normally used to manufacture stranded or bunched conductors and to assemble two or more insulating conductors to form pairs, quads and other twisted conductors mainly used in the telecommunication industry.

Electrical cables, particularly those used in the telecommunications industry, are advantageously provided with one or more electrically conductive shields or screens which wrap around and enclose one or more groups of individual conductors. Such shields or screens help reduce pick-up of external electrical interferences, radiation and cross talk between adjacent conductors within the cable. The greater the conductivity of the shield or screen the better the results that are obtained. One form of shield or screen that is frequently used is a continuous tape coated at least on one side thereof with a conductive material. A metallized Mylar tape is commonly used. The tape can be helically wound or longitudinally applied about the conductor or conductors to be shielded or screened so that successive turns or lays of the tape overlap and make contact. For a tape made of a conductive material or a tape coated on both sides with a conductive material such overlapping contact provides the requisite conductivity of the shield. For tapes coated with a conductive material on one side only, the tape needs to be folded so that there is electrical continuity between successive turns or lays. In some instances a drain wire is wrapped on one or both sides of the tape shield to bridge successive turns and provide or enhance the required conductivity. Numerous cable designs have been proposed, each normally for a specific or a particular purpose. Some examples of shielded cables which use tape to provide the shield or screen are described in the following U.S. Pat. Nos. 4,323,721; 4,327,246; and 4,406,914.

Taped conductors or assemblies have been traditionally made in the past on single twist machines since the tape would be cracked or unacceptably stretched during the second twist imparted by a double twist machine.

Therefore, up to now the production of tape and/or screened products widely used in the telecommunication and specialty cable industries were made on slower machines.

The attempts to utilize double twist equipment was not successful because, as mentioned, the second twist imparted on the products at the end of the bow, would damage the taped conductor or assembly, thus producing cables of unacceptable quality.

Therefore, the state-of-the-art equipment can produce acceptable product only at slower speeds on single twist or equivalent machines.

SUMMARY OF THE INVENTION

In view of the aforementioned disadvantages inherent in the process of manufacturing taped conductors with single twist or equivalent machines, it is an object of the present invention to provide an apparatus for manufacturing taped and screened conductors and assemblies with a high quality, utilizing a double twist machine.

It is another object of the present invention to provide an improved method to produce high quality taped and screened conductors and assemblies at substantially higher speeds on a double twist machine.

It is still another object of the present invention to provide a method to produce high quality taped or screened conductors and assemblies with either or both longitudinally applied and radially applied tapes at substantially higher speeds on double twist equipment, with or without pre-folding of the applied tape.

In order to achieve the above objectives as well as others, it will become apparent hereafter that an apparatus for making taped and screened conductors and assemblies in accordance with the present invention comprises means for providing a wire or a plurality of insulated wires or a plurality of twinned or quadded conductors having the desired configuration.

Means are provided for paying off one or more tapes and for winding the tapes around the assembled conductors.

The wires and the tapes are then pulled through a pre-twisting device which imparts to the assembled conductors and tapes the number of twists required to obtain the desired tape tension on the final product, this twist being approximately twice the speed of the bow of the double twist machine.

This method allows accurate metering of the amount of tape and control of the final tape tension. The conductors and the tape are therefore assembled correctly before entering the pretwisting device. Between the exit of the pretwisting device and the entry pulley of the double twist-bow, the lay is longer and proportional to the difference between pretwister speed and bow speed. Normally the lay is approximately doubled since the pretwister is usually run roughly at twice the speed of the bow. The desired final product lay is then achieved at the exit pulley of the bow and from there the assembled and taped conductor is wound on a takeup reel in a normal fashion.

The pretwister speed can be varied to control the tightness of the taping process and, if so desired, it can be independently driven instead of having it rotate at roughly twice the speed of the bow. This method allows the manufacture of high quality taped and screened conductors and assemblies on a double twist machine at substantially higher speeds than was previously possible.

The present invention also contemplates the use of two or more pay-off sections and associated tape applicating devices with a single pre-twister and double twist buncher to produce a final product which incorporates separately grouped and shielded strands or wires, with or without a common external shielding tape. A common drain wire can also be added to any shielded cable irrespective of the final cable configuration. Drain wires can also be added to any shielded conductor groups and/or to the final cable configuration either on the inside or the outside depending on which face of the shielding tape is coated with an electrically conductive material.

BRIEF DESCRIPTION OF THE DRAWINGS

Other objects of the present invention in addition to those set forth above will become apparent to those skilled in the art from the following description taken in connection with the accompanying drawings, wherein.

DESCRIPTION OF THE PREFERRED EMBODIMENT

Figure 1:
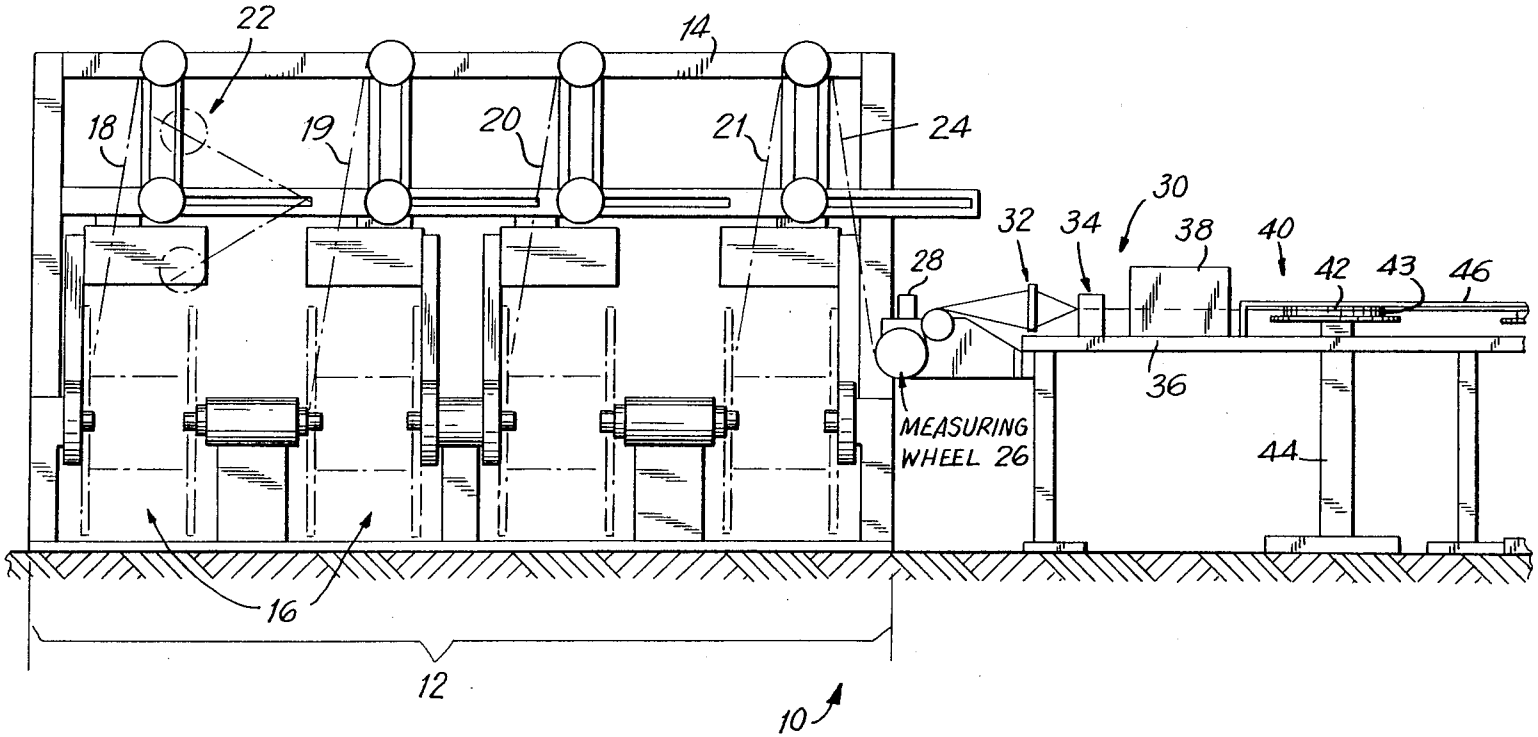
FIG. 1 is a side elevational view of the front end of the apparatus in accordance with the invention, the rest of the apparatus being shown in FIG. 2.

Referring now specifically to the Figures, where identical or similar parts are designated by the same reference numerals throughout, and first referring to FIG. 1, the apparatus in accordance with the present invention is generally designated by the reference numeral 10.

The apparatus 10 includes a pay-off section 12 upstream or at the beginning of the line of the apparatus or machine which supplies at least one continuous filament of material As will become evident to those skilled in the art from the description that follows, the apparatus in accordance with the invention can be used to apply a tape, made out of any material, onto one or more continuous filaments. The number of filaments which are to be processed simultaneously through the apparatus 10, the number of tapes to be wrapped around such filament or filaments is not critical for purposes of the present invention. The invention will be described, however, in relation to an electrical cable to be formed of two or more electrical conductors or wires which are to be twisted in relation to one another. Also, the invention will be described in relation to such a cable which is provided with a conductive shield or screen applied in the form of a continuous tape having at least one side thereof coated with an electrically conductive material. However, as noted, an insulating tape can be used, which does not have a conductive coating, in the same manner.

The pay-off section 12 is shown to include a frame 14 which is proximate to a plurality of bobbins or reels 16 each of which supplies an individual electrical wire or conductor 18–21 all of which which are to be twisted or stranded in relation to one another in a final cable product. Each of the wires or conductors 18–21 passes over a series of sheaves which comprise dancer mechanisms 22 which control the tension in the wires or conductors 18–21 within desired ranges of tension. The dancers 22 are optional and do not form a critical part of the present invention.

At the output of the pay-off section 12 the plurality or composite group of wires or conductors 24 are passed through a measuring device, such as measuring wheel 26 for measuring the linear speed or velocity of the composite or group of wires 24 entering the downstream section of the apparatus 10. An encoder 28 cooperates with a measuring wheel 26 to convert the linear speed information into electrical signals which will be more fully discussed hereafter.

The composite group of wires 24 are then directed through positioning means generally designated by the reference numeral 30 which advantageously includes both a lay plate 32 and a closing die 34 which arrange and orient the individual wires or conductors 18–21 into a desired configuration and fix the wires or filaments 24 relative to the center line or axis of the machine, as well as fix these wires in relation to the rotating equipment which is located downstream in the line of the apparatus 10. The positioning means 30 is shown mounted on an elongate support or table 36 which extends in a direction substantially parallel to the center line or the axis of the machine or apparatus 10 along which the composite group or plurality of wires 24.

The apparatus 10 is also shown in FIG. 1 to include an optional spark test electrode 38 on the support 36 which is used to test the electrical insulation about the electrical conductors. The spark test electrode 38, however, is not a critical feature of the present invention.

Figure 2:
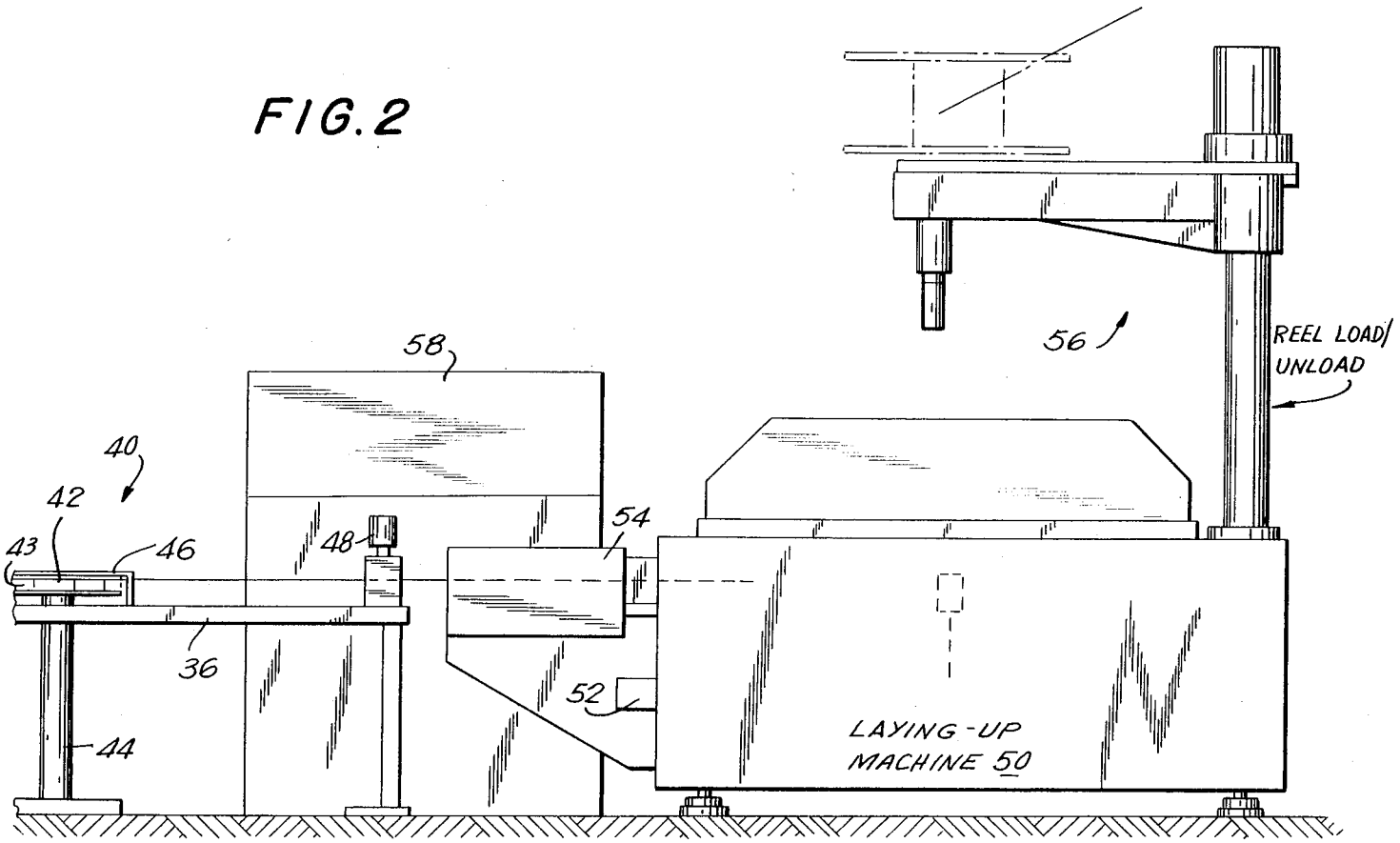
FIG. 2 is a side elevational view of the back end of the apparatus in accordance with the present invention, the front end being shown in FIG. 1.

Importantly, there is provided at least one tape applying device, shown in FIGS. 1 and 2 as being longitudinal tape applicators 42 each supported on a stand 44. Typically two such longitudinal tape applicators 42 are provided, although the specific number is not a critical feature of the invention.

The tape applicators 42, as will become more apparent hereafter, serve to dispense at least one continuous tape 43 to be wrapped or wound about the plurality of wires or conductors 24 once the same have been twisted about each other.

Figure 4:
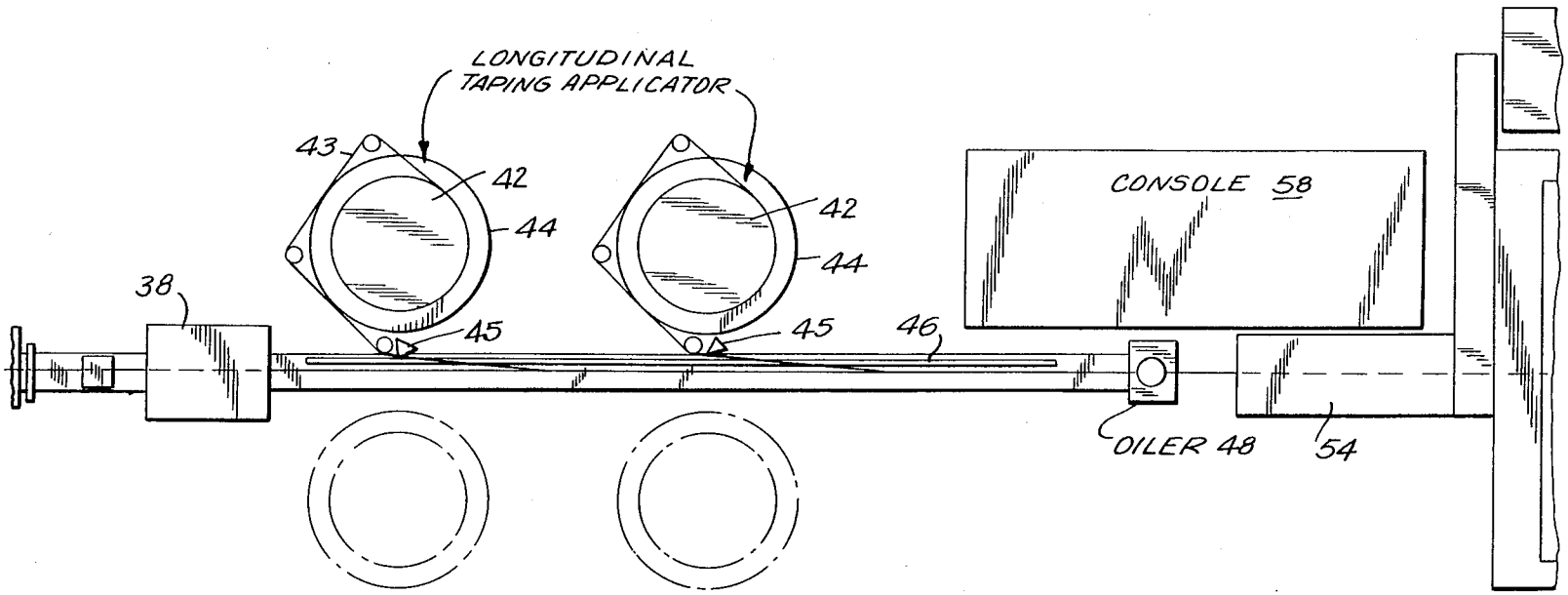
FIG. 4 is an enlarged top plan view of a portion of the apparatus shown in FIGS. 1 and 2, showing the relative positions of the taping applicators or taping heads in relation to the apparatus and the manner in which the tapes are applied or wrapped around the cable.

Referring to FIG. 4, there are shown two tape applicators 42 and the manner in which the tapes 43 are payed off, folded along their lengths by folders 45 and applied to the electrical conductors. Advantageously, there is provided at least one guide bar 46 which is substantially parallel to the axis or center line of the machine and proximate to the twisted wires or conductors, and arranged to initially contact the tape 43 prior to being wrapped about the electrical conductors. A single guide bar can be used for two or more tape applicators or taping heads or, alternately, two or more guide bars can be used each cooperating with a different tape applicator. The purpose of the guide bars 46 are to absorb some of the tension and forces which are applied on the tape and, therefore, result in less pull on the product The lateral pulling forces on the tape are, in essence, absorbed by the bar and not by the product itself which would otherwise be deflected off of the machine axis or center and result in possible damage to the tape or irregularities in the application thereof. Referring to FIG. 2, showing the downstream or back end of the apparatus 10, there is also shown mounted on the support 36 an optional oiler 48 which may be incorporated into the line and can be of conventional design.

A double twist machine 50 is shown downstream from the positioning elements 30 which receives the multiple filaments or strands or conductors 24 and imparts a double twist thereto. Such double twist machines are widely known, as suggested in the Background Of the Invention. Depending on the specific application and the type of product which is desired, such machines may be double twist twinners, double twist stranders, cablers and bunchers. The specific type of machine used for imparting two twists to the product is not critical and any such machine can be used depending on the configuration of the desired final product.

Associated with the machine 50, there is provided an encoder 52 which monitors the rotational speed of the double twist machine 50 so that the speed of the machine 50 can be coordinated with the linear velocity of the strands or wires 24 which are supplied by the payoff device 12. In this way, it is assured a satisfactory lay control is achieved. Lay control can also be achieved by mechanically connecting the measuring wheel 26 to the bow of the double twist machine 50 through a multi-speed gear box as is well known to people who are skilled in the art.

An important feature of the present invention is the provision of a pre-twisting device 54 between the positioning location 30 and the double twist machine 50 for engaging the continuous filaments, wires or conductors 24 and imparting a pre-determined transitory or temporary twist thereto. The details of one arrangement for a pre-twisting device 54 will be more fully described below in connection with FIG. 3 Also shown in FIG. 2 is a reel loading and unloading mechanism 56 for loading empty reels and unloading reels filled with the twisted and taped final product. An operator console 58 is shown schematically which contains the controls for operating the apparatus 10.

Figure 3:
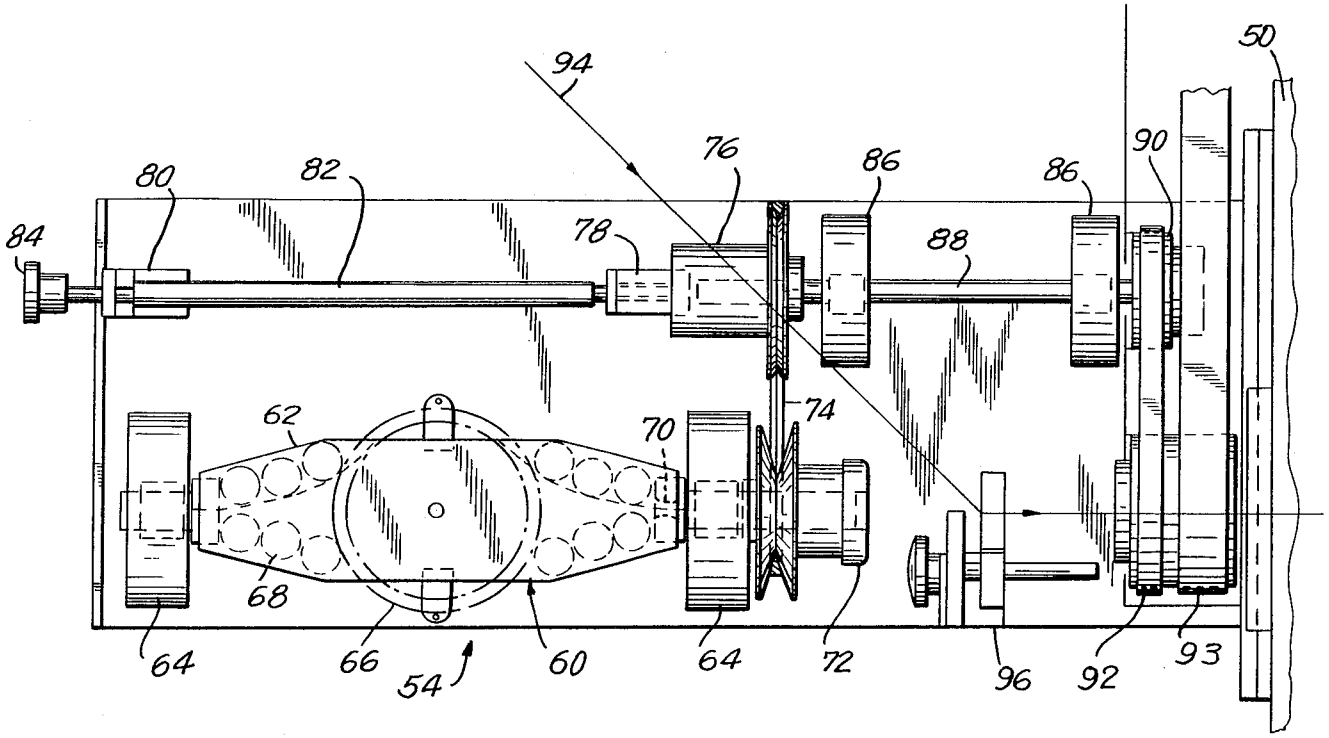
FIG. 3 is an enlarged top plan view showing the details of the pre-twister device shown in FIG. 2.

Referring to FIG. 3, the pre-twister device 54 is shown to include a pre-twister assembly 60 consisting of two spaced and parallel guide frames 62 disposed along and mounted for rotation on pillow blocks 64 substantially about the machine center line or axis, and includes a sheave or pulley 66 mounted on the assembly 60 for rotation about an axis substantially normal to the machine center line or axis. As shown, the pre-twister assembly advantageously includes guide means for guiding one or more filaments, wires or conductors into contact with the sheave or pulley 66. In a presently preferred embodiment, such guide means includes a plurality of rollers 68 mounted on the guide frames 62 and arranged substantially along the path of the group or plurality of filaments or conductors, the rollers 68 are advantageously mounted on the bearings as is the pre-twister sheave 66. There is also preferably provided a wire guide bushing 70 downstream from the sheave 66 for guiding the plurality of filaments or conductors and returning the same to the center line or axis of the machine.

The pre-twister assembly 60 is rotated, in the embodiment being described, at approximately twice the rotational speed of the double twisting machine 50 and is driven by means of a spring-loaded variable pitch sheave 72 which is coupled by means of a V-belt 74 to a manually controlled variable pitch sheave 76. The sheave 76 is, in turn, by means of mounted brackets 78 and 80, connected to a shaft extension 82 which is terminated by a manual hand knob 84. The sheave 76 is, by means of pillow blocks 86, coupled to jack shaft 88 which is mechanically coupled to the timing belt pulley 90. The timing belt pulley 90 is, in turn, driven by a timing belt 92 and a main drive belt 94 which also drives the double twist machine 50. By selecting the diameters of the various sheaves and gear ratios, the pre-twister assembly 60 can be made to rotate at a rotational speed of approximately twice that of the double twist machine 50. In the preferred embodiment, however, twice the speed of the double twist machine is a nominal velocity or speed for the pre-twister assembly 60, and small variations about that nominal velocity can be effected by means of the manual hand knob 84. It will be clear that by adjusting the knob 84, the pitch of the sheaves 72 and 76 can be changed thereby, effectively, changing the relative diameters of these sheaves and, therefore, the absolute rotational velocity of the pre-twister assembly 60.

Also shown in FIG. 3 is a die assembly 96 which accommodates a drain wire 94. The use of such drain wire is optional, but when it is used, it provides additional conductivity to the shield or the screen established by the applied conductive tape.

The position of the die assembly 96 can be changed in the direction of the axis of the machine and this allows variation of the position of the drain wire around the assembled and taped cable. Although the drain wire is applied in this embodiment after the pre-twister, drain wires can be applied before or after each individual tape applicator depending on the type of shield required and on which face of the tape is coated with an electrically conductive material.

The operation of the apparatus 10 will now be described. After the individual filaments, wire or conductors 18–21 are payed off, they are initially arranged in desired relative positions to each other and are substantially fixed in relation to the center line or axis of the machine by the positioning devices 32,34. The tape applicators 42 are arranged relative to the support 36 to provide application of the tapes 43 about the twisted conductors or wires (FIG. 4). In the preferred embodiment, two tape applicators are shown, one downstream from the other. This is not critical, and one longitudinal tape applicator or one taping head or more than two longitudinal tape applicators or taping heads can be used and, if desired, these can be positioned in different arrangements. Rotating taping heads which could be used are shown, for example, in the Ceeco Group Product Catalog for Electrical Wire & Cable Machinery, at pages 26 and 27. Shown in dashed outline in FIG. 4 are two alternate positions for the taping heads.

As should be evident, taping may be effected of only a single filament, a plurality of twisted filaments, or groups of filaments within one composite cable.

In the case of a cable made of electrical conductors requiring an electrical shield or screen, a continuous tape 43 is used which may be made of an insulated material such as Mylar and coated on one side with a metallized conductive material. In such event, the tape 43 is folded in folding device 45 to expose the conductive surface on both external faces or sides of the folded tape. Such folded tape is helically wound about the conductors to be shielded so that successive turns or lays of the tape overlap to make contact. Such folding of the tape provides electrical continuity between successive turns or lays of the tape. The drain wire 94 is further introduced and wrapped about the outside conductive surface of the tape to bridge successive turns and provide or enhance the conductivity of the shield or screen.

In the embodiment shown, four conductors 18–21 are shown being payed off and processed. Rotation of the pre-twisting device 54 and the double twist machine causes the twists on the individual filaments or strands to travel upstream until they meet a fixed position, in this case the positioning devices including the lay plate 32 and the closing die 34. The tapes 43 are pulled in by the twist imparted by the pre-twister. Without the pre-twist device 54, the use of a double twist machine in producing taped products has not been successful because the second twist imparted by the double twist machine is normally sufficient to break or damage the tape to render the product unacceptable. This has stemed from the fact that the tape is initially applied in a fixed length prior to introduction into the double twist machine 50. However, each time the filaments or wires are twisted, the lay of the twisted wires including the tape is reduced and the tape effectively stretched.

In the use of the apparatus of the invention, the pre-twisting device 54 is rotated in the same direction as the double twist machine and can be effectively speeded up to impart a transitory or temporary twist to the wires or filaments 24 so that initially a slightly greater amount of tape than the length, required after the second twist is applied at the desired tension. For example, if the double twist machine is run at 2,000 rpm, the pre-twisting device can be rotated at approximately 4200 rpm. This would result in 4200 twists per minute by the pre-twisting device 54, while providing 2000 twists during each twisting operation of the double twist machine for a total of 4000 twists. By rotating the pre-twisting device at a slightly higher speed, there is initially a shorter lay and therefore more tape will be pulled in than would normally be required. The number of twists imparted by the double twist machine is lower than those imparted by the pre-twister and therefore there is a relaxation and the effective length of the lay increases resulting in a slackening of the tape. The final lay is determined by the higher speed and the rotational speed of the double twist machine, and the double twisting device 54 imparts over a transitory lay. One can, therefore, control the tightness of the tape around the product and the apparatus permits the production of a desirable product without the tape being unduly tensioned or deformed or damaged. It is, however, also possible to increase the tension in the tape and therefore tighten the product by simply adjusting the manual hand knob 84. By reducing the rotational speed of the pre-twisting device 54 below the 4000 rpm in the example given, less tape would initially be applied on a given lay of wire, and subsequent twisting of the wire for an effective 4000 revolutions or twists would shorten the lay of the tape and tighten the same about the assembled conductors.

It should be understood that although a preferred embodiment of the present invention has been illustrated and described, various modifications, alternatives and equivalents thereof will become apparent to those skilled in the art and, accordingly, the scope of the present invention should be defined only by the appended claims and equivalents thereof For example, while the drive for the pre-twister device 54 has been shown to be mechanically coupled to the main drive of the double twist machine 50, any variable speed coupling or independent drives can be used for the pre-twisting device and for the double twist machine. Such independent drives, and the means for controlling or regulating the rotational speeds thereof to provide the necessary synchronization and operation, are well known to those skilled in the art.

What is claimed is:

1. Apparatus for manufacturing a taped product and having a machine center line comprising;

(a) payoff means for paying off at least one continuous filament of material;

(b) positioning means for substantially fixing the position of said at least one continuous filament relative to said machine center line;

(c) a double twist machine downstream from said positioning means for receiving said at least one continuous filament and imparting a double twist thereto;

(d) pre-twisting means between said positioning means and said double twist machine for engaging said at least one continuous filament and imparting a predetermined transitory twist thereto between said positioning and said pre-twisting means;

(e) tape applying means for dispensing and applying at least one continuous tape to said at least one continuous filament between said positioning and said pre-twisting means; and (f) control means for controlling the rotation speed of said pre-twisting means relative to the rotation speed of said double twist machine to thereby control the tape tension on the taped product

2. Apparatus as defined in claim 1, wherein said payoff means provides a plurality of continuous filaments, and wherein said positioning means includes a lay plate along said machine center line.

3. Apparatus as defined in claim 1, and wherein said positioning means includes a closing die along said machine center line.

4. Apparatus as defined in claim 1, where said payoff means provides a plurality of continuous filaments, and wherein said positioning means includes a lay plate and a closing die downstream from said lay plate for arranging said plurality of filaments into predetermined relative positions prior to being twisted.

5. Apparatus as defined in claim 1, wherein said pre-twisting means comprises a pre-twister assembly disposed along and mounted for rotation substantially about the machine center line and includes at least one sheave mounted on said assembly for rotation about an axis substantially normal to the machine center line.

6. Apparatus as defined in claim 5, wherein said pre-twister assembly includes guide means for guiding said at least one filament into contact with said sheave.

7. Apparatus as defined in claim 6, wherein said guide means includes a plurality of roller means mounted on said pre-twister asembly.

8. Apparatus as defined in claim 6, wherein said guide means includes a bushing downstream from said sheave.

9. Apparatus as defined in claim, 1, wherein a plurality of tape dispensers are provided each for applying a continuous tape to said at least one filament.

10. Apparatus as defined in claim 1, wherein said tape applying means further comprises at least one guide member disposed proximate to said at least one filament for engaging said at least one tape and deflecting the direction thereof prior to wrapping the same onto said at least one filament.

11. Apparatus as defined in claim 10, wherein a plurality of tape dispensers are provided, and further comprising a plurality of guide members each for engaging at least one continuous tape before the same is wrapped about said at least one filament.

12. Apparatus as defined in claim 1, wherein said at least one filament comprises a plurality of electrical conductors, and wherein said tape has a conductive coating at least on one side thereof, said tape applying means including folding means for folding the tape along a longitudinal line substantially parallel to the edges of said tape to provide said conductive coating on both sides of the resulting folded tape, whereby successive overlapping wraps of said folded tape are placed into physical and electrical contact with each other to thereby maximize the electrical conductivity of the shield or screen thereby formed by said tape.

13. Apparatus as defined in claim 1, wherein said at least one filament comprises a plurality of electrical conductors, and wherein said tape has a conductive coating on at least one side thereof, further comprising drain wire applying means for applying at least one continuous conductive drain wire to said plurality of electrical conductors for contact with said at least one conductive coating on said tape.

14. Apparatus as defined in claim 13, wherein said tape is applied to dispose said at least one conductive coating on the outside or external side of the resulting screen or shield and said drain wire applying means being arranged to introduce said at least one drain wire between said pre-twisting means and said double twist machine.

15. Apparatus as defined in claim 13, wherein said tape is applied to dispose said at least one conductive coating on the inside or interior side of the resulting screen or shield and said drain wire applying means being arranged to introduce said at least one drain wire between said positioning means and said tape applying means.

16. Apparatus as defined in claim 1, wherein said control means includes mechanical coupling means for mechanically coupling said pre-twisting means and said double twist machine.

17. Apparatus as defined in claim 1, wherein said control means comprises independent drives for said pre-twisting means and for said double twist machine, and adjusting means for adjusting at least one of said drives to provide the desired relative rotation speeds.

18. Apparatus as defined in claim 1, wherein said control means includes adjusting means for adjusting the speed of said pre-twisting means relative to the speed of said double twist machine, whereby the tension of said at least one tape about said at least one filament can be adjusted.

19. Apparatus as defined in claim 1, wherein the ratio of speeds between said pre-twisting means and said double twist machine is fixed at a predetermined ratio.

20. Apparatus as defined in claim 16, wherein said control means includes adjusting means for adjusting the speed of said pre-twisting means relative to the speed of said double twist machine, and wherein said adjusting means includes a first V-shaped sheave drive for said pre-twisting means, and a manually controlled variable pitch second sheave coupled to said first sheave by means of a V-shaped belt; and manual means for adjusting the pitch of said second sheave to thereby control the rotation speed of said pre-twisting means.

21. Apparatus as defined in claim 1, further comprising measuring means for measuring the linear speed at which said at least one filament is advanced from said payoff means; and regulating means for regulating the rotation speeds of said double twist machine as a function of the rate at which said at least one filament is payed off to thereby provide a continuous control of the product lay.

22. Apparatus as defined in claim 1, further comprising metering means for metering the linear speed at which said at least one filament is advanced from said pay-off means; and mechanical coupling means connecting said metering means to said double twist machine to effect desired lay control.

23. Method of manufacturing a taped product comprising the steps of:

(a) paying off at least one continuous filament of material and directing the same along a center line;

(b) substantially fixing the position of said at least one continuous filament relative to said center line;

(c) imparting a double twist thereto to said at least one continuous filament downstream from the point where the latter is fixed relative to said center line;

(d) engaging and pre-twisting said at least one continuous filament and imparting a predetermined transitory twist thereto between the point of positioning and pre-twisting;

(e) dispensing and applying at least one continuous tape to said to said at least one continuous filament between said points of positioning and pre-twisting; and (f) controlling the speed of pre-twisting relative to the speed of double twisting to thereby control the tape tension on the taped product.

24. A method as defined in claim 22, further comprising the step of adjusting the relative speeds of pre-twisting and double twisting for modifying the tension of the tape about aid at lest one filament.

25. Method as defined in claim 23, wherein said at least one filament comprises a plurality of electrical conductors, and wherein said tape has a conductive coating at least on one side thereof, and further comprising the step of applying at least one continuous conductive drain wire to said plurality of electrical conductors for contact with said at least one conductive coating on said tape.

26. Method as defined in claim 25, wherein said drain wire is applied prior to application of said tape.

27. Method as defined in claim 25, wherein said drain wire is applied subsequent to application of said tape.

28. Method of using a pre-twising device for manufacturing a taped product on an apparatus and having a machine center line comprising;

(a) providing payoff means for paying off at least one continuous filament of material;

(b) providing positioning means for substantially fixing the position of said at least one continuous filament relative to said machine center line;

(c) providing a double twist machine downstream from said positioning means for receiving said at least one continuous filament and imparting a double twist thereto;

(d) providing pre-twisting means between said positioning means and said double twist machine for engaging said at least one continuous filament and imparting a predetermined transitory twist thereto between said positioning and said pre-twisting means;

(e) providing tape applying means for dispensing and applying at least one continuous tape to said at least one continuous filament between said positioning and said pre-twisting means; and (f) providing control means for controlling the rotation speed of said pre-twisting means relative to the rotation speed of said double twist machine to thereby control the tape tension in the taped product.

* * * * *